US006094974A

United States Patent [19]

Yamagishi et al.

[11] Patent Number: 6,094,974

[45] Date of Patent: Aug. 1, 2000

[54] SELF-DIAGNOSING APPARATUS AND METHOD OF VARIABLE VALVE TIMING STRUCTURE

[75] Inventors: Yoichiro Yamagishi; Satoru Watanabe, both of Atsugi, Japan

[73] Assignee: Unisia Jecs Corporation, Kanagawa-ken, Japan

[21] Appl. No.: 09/089,545

[22] Filed: Jun. 3, 1998

[30] Foreign Application Priority Data

Jun. 12, 1997 [JP] Japan ..... 9-155371

[51] Int. Cl.[7] ..... G01L 3/26

[52] U.S. Cl. ..... 73/117.3; 73/118.1; 123/90.16

[58] Field of Search ..... 73/117.3, 118.1, 73/116; 123/90.15, 90.16

[56] References Cited

U.S. PATENT DOCUMENTS 5,495,830 3/1996 Wu ..... 123/90.15
5,549,080 8/1996 Uchikawa ..... 123/90.16
5,626,108 5/1997 Kato et al. ..... 123/90.15
5,644,073 7/1997 Matsuno et al. ..... 73/118.1

FOREIGN PATENT DOCUMENTS 8-246820 9/1996 Japan .

*Primary Examiner*—Max Noori
*Assistant Examiner*—Maurice Stevens
*Attorney, Agent, or Firm*—McDermott, Will & Emery

[57] ABSTRACT

In a variable valve timing structure for changing the opening/closing timing of the intake valve and/or the exhaust valve by changing the rotation phase of a cam shaft corresponding to a target value, wherein the deviation between the actual rotation phase at the point of time after a predetermined time has passed from a step-change of the target value and the target value after the step-change is equal to or above a predetermined value, an abnormality of response characteristic of the variable valve timing structure is judged.

16 Claims, 3 Drawing Sheets

SELF-DIAGNOSING APPARATUS AND METHOD OF VARIABLE VALVE TIMING STRUCTURE

BACKGROUND OF THE INVENTION (1) Field of the Invention

The present invention relates to a self-diagnosing apparatus and method of a variable valve timing structure for varying the opening/closing timing of an intake valve and/or an exhaust valve by changing the rotation phase of a cam shaft in an internal combustion engine.

(2) Related Art of the Invention

In the prior art, a variable valve timing structure for advancing or delaying the opening/closing timing of an intake valve and/or an exhaust valve by changing the rotation phase of a cam shaft in an internal combustion engine was known.

Further, when the rotation phase of the cam shaft was stable, abnormality of the rotation phase was diagnosed based on the detection results of the rotation phase (refer to Japanese Unexamined Patent Publication No.8-246820).

However, the diagnosis of abnormality in the prior art was for diagnosing the regular abnormality of the rotation phase, and it was not capable of diagnosing the deterioration of response characteristic of the change in rotation phase in the step-like change of the target.

When deterioration occurs to the response characteristic, it takes time to reach the required valve timing (rotation phase) from the driving condition, so the intake/exhaust valve could not be open/close driven by the most suitable valve timing during this response delay, which may deteriorate the driving performance. Therefore, it was necessary to diagnose the deterioration of the response characteristic.

SUMMARY OF THE INVENTION

The present invention aims at solving the above-mentioned problems, and the object of the present invention is to provide a self-diagnosing apparatus and method enabling diagnosis of a deterioration in response characteristics of a variable valve timing structure.

Further object of the present invention is to provide a self-diagnosing apparatus and method for diagnosing the deterioration of the response characteristic with high accuracy, independent from conditions such as the oil temperature or the power source voltage.

In order to achieve the above-mentioned objects, with the present invention, there is provided a self-diagnosing apparatus and method of a variable valve timing structure for varying the opening/closing timing of an intake valve and/or an exhaust valve by changing a rotation phase of a cam shaft corresponding to a target value, wherein an actual rotation phase is detected at a time when a predetermined time has passed after the target value has step-changed, and when the deviation between the detected result of the rotation phase and the target value after the step-change is equal to or larger than a predetermined value, judging an abnormality of response characteristic of the variable valve timing structure, and outputting a signal of the determined result.

According to such a construction, when the target value of the rotation phase is changed by steps, and the actual rotation phase is changed following such step-change of the target value, it is diagnosed as response abnormality if the actual rotation phase has not changed close to the target value after a predetermined time has passed.

At this time, the predetermined time may be changed corresponding to the step-change quantity of the target value, or, the predetermined value may be changed corresponding to the step-change quantity of the target value.

According to such a construction, even when the response characteristic is normal, it would take a longer time than when the step-change quantity is small to catch up with the target value when the step-change quantity is large. When comparing the two by the same lapse of time, the deviation against the target value becomes larger. Therefore, the point of time when comparing the actual rotation phase and the target value is changed corresponding to the step-change quantity, or the judgment level when diagnosing abnormality based on the deviation between the actual rotation phase and the target value is changed corresponding to the step-change quantity.

Further, in the case where the variable valve timing structure changes the rotation phase of the cam shaft by hydraulic pressure, the diagnose is performed only when the temperature of the operation oil of the variable valve timing structure is equal to or above a predetermined temperature.

According to such a construction, when the temperature of the operation oil is low, the response speed will be reduced, and it would appear that a deterioration of response characteristic has occurred. Therefore, the diagnosis is performed when the temperature of the operation oil is sufficiently high, so as to diagnose the occurrence of deterioration of response characteristic caused by a factor other than oil temperature.

Even further, in the case where the variable timing structure is constructed to change the rotation phase of the cam shaft by hydraulic pressure, the predetermined time may be changed corresponding to the temperature of the operation oil of the variable valve timing structure, and the predetermined value may be changed corresponding to the temperature of the operation oil of the variable valve timing structure.

According to such a construction, since the response speed changes according to the operation oil temperature, the point of time for comparing the actual rotation phase and the target value is changed in correspondence to the oil temperature, and/or the judgment level of when diagnosing abnormality based on the deviation between the actual rotation phase and the target value is changed in correspondence to the oil temperature.

Further, in the case where the variable timing structure changes the rotation phase of the cam shaft by hydraulic pressure, and the hydraulic pressure is controlled by a linear solenoid valve, the predetermined time may be changed in correspondence to the power source voltage of the linear solenoid valve, or, the predetermined value may be changed in correspondence to the power source voltage of the linear solenoid valve.

According to such a construction, the response speed changes when the power source voltage of the linear solenoid valve changes even if the conditions such as the step-change quantity or the oil temperature are the same, so the point of time when comparing the actual rotation phase and the target value is changed in correspondence to the power source voltage, or the judgment level for diagnosing abnormality based on the deviation between the actual rotation phase and the target value is changed in correspondence to the power source voltage.

On the other hand, when the predetermined time has passed after the target value has step-changed, the detected result of the actual rotation phase is approximately fixed, and the deviation between the actual rotation phase and the target value of the rotation phase at that time is equal to or above the predetermined value, then it is preferable to have a construction for judging a regular abnormality of the rotation phase of the variable valve timing structure and outputting the signal of the judgment results.

According to such a construction, the target value and the actual rotation phase is compared at the point where the actual rotation phase is approximately fixed following the step-change of the target value, and if the deviation is equal to or above the predetermined value, it is diagnosed that a regular deviation is occurred in the rotation phase.

These and other objects of the present invention will become apparent from the following explanation of the embodiments related to the accompanied drawings.

DETAILED DESCRIPTION OF THE PREFERRED EMBODIMENT

The preferred embodiment of the present invention will hereinafter be explained based on the drawings.

Figure 1:
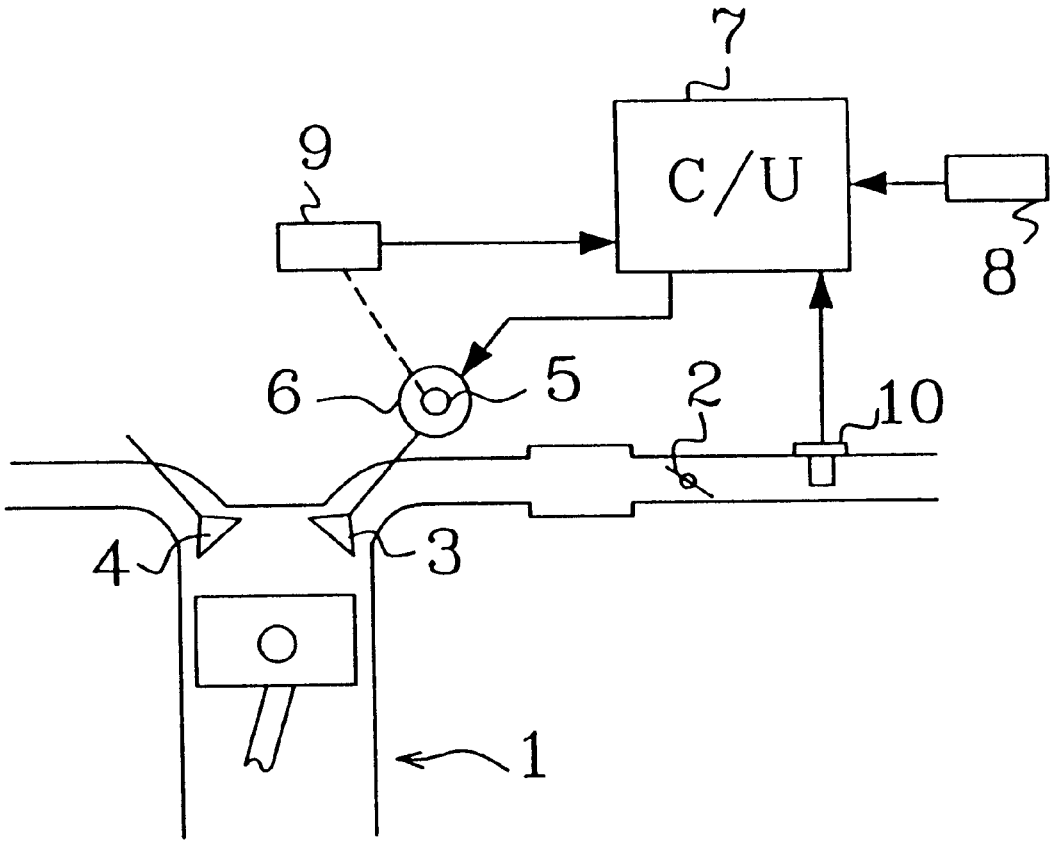
FIG. 1 is a diagram showing the system structure of the internal combustion engine according to the preferred embodiment.

FIG. 1 is a diagram showing the system structure of an internal combustion engine according to the embodiment.

FIG. 1 shows an internal combustion engine 1 wherein air measured at a throttle valve 2 is supplied into a cylinder through an intake valve 3, and combusted exhaust is discharged through an exhaust valve 4. The intake valve 3 and the exhaust valve 4 are open/close driven by a cam mounted to each of an intake side cam shaft and an exhaust side cam shaft.

On an intake side cam shaft 5 is equipped with a variable valve timing structure 6 for continuously advancing or delaying the opening/closing timing of the intake valve 3 by changing the rotation phase of the cam shaft.

The variable valve timing structure 6 is constructed to continuously change the rotation phase by hydraulic pressure, wherein the rotation phase of the cam shaft is controlled by controlling the amount of electricity provided to a linear solenoid valve (not shown in the drawing) for adjusting the hydraulic pressure in correspondence to a duty (ON duty) of an electricity control signal output from a control unit 7. Further, the most delayed angle side and the most advanced angle side of the rotation phase is set to be limited by a stopper, which is formed to contact the stopper on the most advanced angle side before reaching 100% when the duty is increased, and formed to contact the stopper on the most delayed angle side before reaching 0% when the duty is decreased.

Further, in the present embodiment, the variable valve timing structure 6 is designed to change the opening/closing timing of the intake valve 3, however, the variable valve timing structure 6 may be designed to change the opening/closing timing of the exhaust valve 4 instead of the intake valve 3, or it may be designed to change the opening/closing timing of both the intake valve 3 and the exhaust valve 4.

In the control unit 7 installing a microcomputer, various signals from a crank angle sensor 8 for outputting a rotation signal of a crank axis, a cam angle sensor 9 for outputting a rotation signal of the intake side cam shaft 5, an air flow meter 10 for detecting an intake air quantity of the engine 1, and so on are input.

The control unit 7 sets a target valve timing (target value in the rotation phase of the cam shaft) of the variable valve timing structure 6 based on the driving conditions such as the engine load or the engine rotation speed, and determines the duty (ON duty) of the electricity control signal so as to realize the target value, and outputs the same to the linear solenoid valve.

Figure 2:
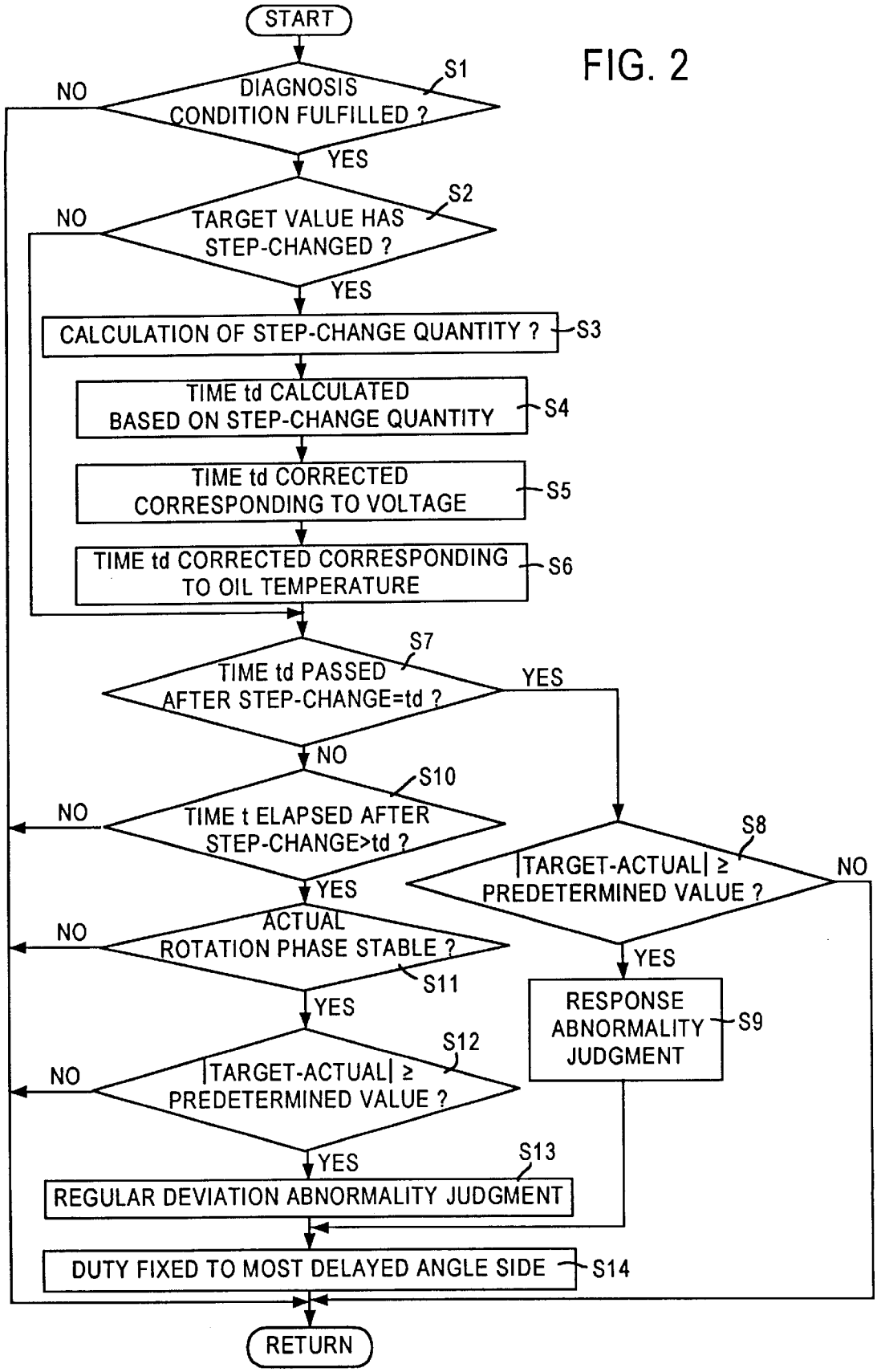
FIG. 2 is a flowchart showing the state of the self-diagnosis in the variable valve timing structure according to the embodiment.

On the other hand, the control unit 7 performs the abnormality diagnosis of the variable valve timing structure 6 as shown in the flowchart of FIG. 2. Here, the function as a response diagnosing device and a regular abnormality diagnosing device are equipped by the control unit 7 as software, which is shown in the flowchart of FIG. 2.

According to the flowchart of FIG. 2, in step S1, it is judged whether a diagnosing condition is realized or not.

At this point, it is preferable to set as the condition for performing the diagnose that no abnormality is diagnosed of the crank angle sensor 8 or the cam angle sensor 9 constructing a rotation phase detecting device for detecting the actual rotation phase, and that the operation oil temperature of the variable valve timing structure 6 is equal to or above a predetermined temperature.

When the diagnosing condition is fulfilled, procedure is advanced to step S2, where it is judged whether or not the target value of the rotation phase of the cam shaft has step-changed.

Figure 3:
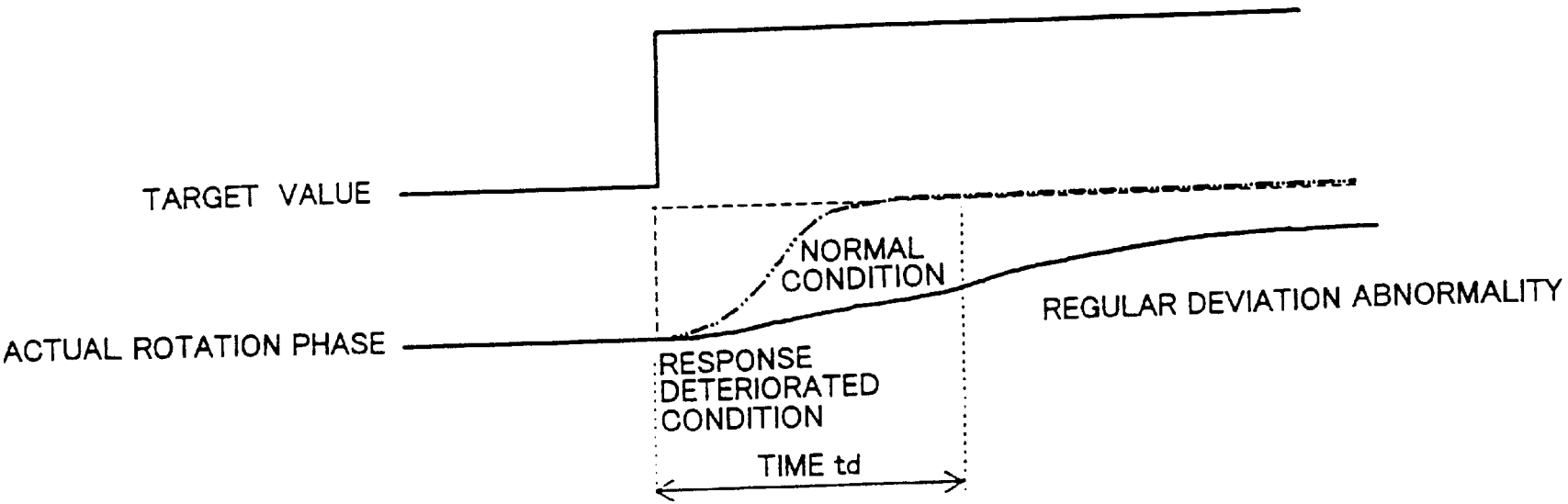
FIG. 3 is a time chart showing the response characteristics of the variable valve timing structure.

When the target value has step-changed, procedure is advanced to step S3, where a difference in target value before and after the step-change is calculated as a step-change quantity, and in step S4, a time td from the step-change of the target value to the execution of response diagnosis is set in correspondence to the step-change quantity (refer to FIG. 3).

In steps S5 and S6, the time td is corrected and set in correspondence to the power source voltage of the linear solenoid valve and the operation oil temperature of the variable valve timing structure 6, thereby finally determining the time td.

The larger the step-change quantity is, the longer the time td is set, and the lower the power source voltage is, or the lower the operation oil temperature is, the longer the time td is corrected.

In step S7, it is distinguished whether the time td has passed or not from the point of time where the step-change of the target value has occurred.

At the point of time where the time td has passed from the time of step-change of the target value (i.e., is t=td?), procedure is advanced to step S8, where it is distinguished whether the absolute value of the deviation between the target value at that point and the actual rotation phase detected based on the detection signal from the crank angle sensor 8 and the cam angle sensor 9 is equal to or above the predetermined value or not. When the absolute value of the deviation is equal to or above the predetermined value, procedure is advanced to step S9, where response abnormality is judged, and the diagnosing signal showing response abnormality is outputted.

The absolute value of the deviation being equal to or above the predetermined value means that the actual rotation phase has not caught up with the target value even after the time td had passed, which had been set by considering the conditions of the step-change quantity, the power source voltage and the oil temperature. This means that an occurrence of deterioration of response characteristic to the variable valve timing structure 6 is presumed (refer to FIG. 3).

When response abnormality is determined in step S9, procedure is advanced to step S14, where the duty (ON duty) of the electricity control signal is set to be fixed to 0% which is the most delayed angle side.

In the above procedure, diagnosis of response abnormality is set to be performed accurately by considering the change of response characteristic by conditions such as the step-change quantity, the power source voltage and the oil temperature, and changing the time td corresponding to such conditions. However, either instead of the time td or with the time td, the predetermined value in step S8 may be set to be changed in correspondence to the step-change quantity, the power source voltage and the oil temperature. That is, when the step-change quantity is large, and the power source voltage and the oil temperature are low, the predetermined quantity is preferably largely changed so that no diagnosis of response abnormality would be performed even when a comparatively large deviation occurs.

On the other hand, when it is determined in step S7 that the time td has not passed from the step-change of the target value, procedure is advanced to step S10, where it is judged whether or not a time t exceeding the time td has passed from the step-change of the target value (i.e., is $t \geqq td$?), and if the time exceeding the time td has passed, procedure is advanced to step S11.

In step S11, it is distinguished whether or not the change of the actual rotation phase detected based on the detection signal from the crank axis sensor 8 and the cam angle sensor 9 is equal to or under the predetermined value, and whether or not the state is approximately steady.

When the actual rotation phase is in a stable state, procedure is advanced to step S12, where it is distinguished whether or not the absolute value of the deviation between the target value and the actual rotation phase is equal to or above the predetermined value.

When the absolute value of the deviation is equal to or above the predetermined value, then procedure is advanced to step S13, where the regular rotation phase abnormality is judged (refer to FIG. 3), outputting a diagnosis signal showing regular abnormality, and proceeding to step S14 where fixture to the most delayed angle side is performed.

Further, it is also possible to carry out a learning correction of the target value based on the deviation between the target value and the actual rotation phase at that time which is compared to the predetermined value at step S12.

What we claimed are:

1. A self-diagnosing apparatus of a variable valve timing structure for changing the opening/closing timing of an intake valve and/or an exhaust valve by changing a rotation phase of a cam shaft corresponding to a target value, said apparatus comprising:

a rotation phase detection means for detecting the rotation phase of said cam shaft;

a response diagnosing means for judging an abnormality in response characteristic of said variable timing structure when, at the point of time where a predetermined time has passed after said target value has step-changed, a deviation between the target value after step-changed and the rotation phase detected by said rotation phase detection means is equal to or above a threshold value, and outputting a signal indicating abnormality of the response characteristic; and a diagnosis time setting means for setting said predetermined time to be longer as the step-change quantity of said target value is larger.

2. A self-diagnosing apparatus of a variable valve timing structure according to claim 1, wherein there is provided a threshold value setting means for changing said threshold value to be greater as the step-change quantity of said target value is larger.

3. A self-diagnosing apparatus of a variable valve timing structure according to claim 1: wherein said variable valve timing structure is constructed to change the rotation phase of said cam shaft by hydraulic pressure; and said response diagnosing means performs the diagnosis only when an operation oil temperature of said variable valve timing structure is equal to or above a predetermined temperature.

4. A self-diagnosing apparatus of a variable valve timing structure according to claim 1: wherein said variable valve timing structure is constructed to change the rotation phase of said cam shaft by hydraulic pressure; and there is provided a correcting means by means of oil temperature for correcting said predetermined time to be longer as an operation oil temperature of said variable valve timing structure is lower.

5. A self-diagnosing apparatus of a variable valve timing structure according to claim 1: wherein said variable valve timing structure is constructed to change the rotation phase of said cam shaft by hydraulic pressure; and there is provided a threshold value setting means for changing said threshold value to be greater as an operation oil temperature of said variable valve timing structure is lower.

6. A self-diagnosing apparatus of a variable valve timing structure according to claim 1, wherein there is provided a correcting means by means of voltage for correcting said predetermined time by the voltage to be longer as the power source voltage of said variable valve timing structure is lower.

7. A self-diagnosing apparatus of a variable valve timing structure according to claim 1, wherein there is provided a threshold value setting means for changing said threshold value to be greater as a power source voltage of said variable valve timing structure is lower.

8. A self-diagnosing apparatus of a variable valve timing structure according to claim 1: further comprising a regular abnormality diagnosing means for judging a regular rotation phase abnormality of said variable valve timing structure, and outputting a signal indicating a regular rotation phase abnormality, when, after said predetermined time has passed from the step-change of said target value, the rotation phase detected by said rotation phase detection means is approximately fixed, and a deviation between the rotation phase detected by said rotation phase detection means and the target value of the rotation phase at that time is equal to or above a threshold value.

9. A self-diagnosing method of a variable valve timing structure for changing the opening/closing timing of an intake valve and/or an exhaust valve by changing a rotation phase of a cam shaft corresponding to a target value, wherein:

an abnormality of response characteristic of said variable valve timing structure is judged, and a signal indicating the abnormality of the response characteristic is output, when a deviation between an actual rotation phase and the target value after a step-change is equal to or above a threshold value at a point of time after a predetermined time which is set to be longer as the step-change quantity of said target value.

10. A self-diagnosing method of a variable valve timing structure according to claim 9, wherein said threshold value is changed to be greater as the step-change quantity of said target value is larger.

11. A self-diagnosing method of a variable valve timing structure according to claim 9: wherein said variable valve timing structure is constructed to change the rotation phase of said cam shaft by hydraulic pressure; and diagnosis is performed only when an operation oil temperature of said variable valve timing structure is equal to or above a predetermined temperature.

12. A self-diagnosing method of a variable valve timing structure according to claim 9: wherein said variable valve timing structure is constructed to change the rotation phase of said cam shaft by hydraulic pressure; and said predetermined time is corrected to be longer as an operation oil temperature of said variable valve timing structure is lower.

13. A self-diagnosing method of a variable valve timing structure according to claim 9, wherein said threshold value is changed to be greater as an operation oil temperature of said variable valve timing structure is lower.

14. A self-diagnosing method of a variable valve timing structure according to claim 9, wherein said predetermined time is corrected to be longer as the power source voltage of said variable valve timing structure is lower.

15. A self-diagnosing method of a variable valve timing structure according to claim 9, wherein said threshold value is changed to be greater as the power source voltage of said variable valve timing structure is lower.

said threshold value is changed to be greater as the power source voltage of said variable valve timing structure is lower.

16. A self-diagnosing method of a variable valve timing structure according to claim 9: wherein after said predetermined time has passed from a step-change of said target value, when the rotation phase detected by said rotation phase detection means is approximately fixed, and when a deviation between the rotation phase detected by said rotation phase detection means and the target value of the rotation phase at that time is equal to or above a threshold value, a regular rotation phase abnormality of said variable valve timing structure is judged, and a signal indicating a regular rotation phase abnormality is output.

* * * * *